US005920040A

United States Patent [19]

Lavacot

[11] Patent Number: 5,920,040

[45] Date of Patent: Jul. 6, 1999

[54] SPEAKER DIAPHRAGM

[75] Inventor: Robert C. Lavacot, La Habra, Calif.

[73] Assignee: Kenneth R. Lavacot, Yorba Linda, Calif.

[21] Appl. No.: 08/845,665

[22] Filed: Apr. 25, 1997

Related U.S. Application Data

[60] Provisional application No. 60/038,524, Feb. 27, 1997.

[51] Int. Cl.[6] ..... G10K 13/00

[52] U.S. Cl. ..... 181/167; 181/169

[58] Field of Search ..... 181/167, 169, 181/170, 173

[56] References Cited

U.S. PATENT DOCUMENTS

| | | | |
|---|---|---|---|
| 1,748,990 | 3/1930 | Nilson . | |
| 1,798,688 | 3/1931 | La Rue . | |
| 1,875,171 | 8/1932 | Sprague et al. . | |
| 1,917,013 | 7/1933 | Bostwick . | |
| 2,036,832 | 4/1936 | Scheldorf . | |
| 2,206,012 | 7/1940 | Hart . | |
| 2,880,817 | 4/1959 | Burns et al. . | |
| 2,890,297 | 6/1959 | Lehr . | |
| 3,907,063 | 9/1975 | Nakazawa et al. | 181/169 |
| 4,020,299 | 4/1977 | Garner et al. . | |
| 4,100,992 | 7/1978 | Rehde et al. . | |
| 4,142,604 | 3/1979 | Smith . | |
| 4,524,846 | 6/1985 | Whitby . | |
| 4,549,631 | 10/1985 | Bose . | |
| 4,628,528 | 12/1986 | Bose et al. . | |
| 5,180,785 | 1/1993 | Uryu et al. | 181/169 |
| 5,191,616 | 3/1993 | Yokoyama . | |
| 5,205,897 | 4/1993 | Nonaka | 181/167 |
| 5,256,837 | 10/1993 | Pak . | |
| 5,309,518 | 5/1994 | Ickler et al. . | |
| 5,313,525 | 5/1994 | Klasco . | |
| 5,588,063 | 12/1996 | Edgar . | |
| 5,594,386 | 1/1997 | Dhuyvetter . | |
| 5,606,624 | 2/1997 | Damato . | |
| 5,744,761 | 4/1998 | Ogura et al. | 181/167 |

*Primary Examiner*—Khanh Dang
*Attorney, Agent, or Firm*—Joseph E. Mueth

[57] ABSTRACT

A diaphragm for a speaker which is adapted, to vibrate, the improvement wherein the preformed diaphragm is treated with a solution containing a polymer which readily dries at about room temperature to leave the polymer adhered to the diaphragm.

13 Claims, No Drawings

SPEAKER DIAPHRAGM

This application claims benefit of USC Provisional Application Ser. No. 60/038,524, filed Feb. 27, 1997.

BACKGROUND OF THE INVENTION

Many types of speaker diaphragms are well-known in the prior art and are used to convert electric vibration into mechanical vibration. The most common type is the cone diaphragm which directs acoustic sounds by mechanical vibration of the cone, Nilson, U.S. Pat. No. 1,748,990, Bostwich, U.S. Pat. No. 1,917,013 and LaRue, U.S. Pat. No. 1,798,688.

Pak, U.S. Pat. No. 5,256,837 discloses a speaker cone formed by the steps of cutting a sheet of paper into a pattern simultaneously with seaming several folding lines into wing portions to reinforce the cone, adhesive bonding the facing surfaces of the folded portions, and, coating the entire surface of the article with moisture proof material such as tar, oiled paint, or enamel.

Rehde et al, U.S. Pat. No. 4,100,992 provides a loudspeaker including a porous conical diaphragm fixed in its central zone to the bobbin of an electromagnetic drive element. The diaphragm is totally permeated with a varnish of cellulose type to serve as a stiffening material. This varnish penetrant is disclosed to be of sufficient fluidity to permit penetration into the texture of the very thin membrane forming the diaphragm without increasing the thickness. The permeated portion of the diaphragm may also be limited to a circular zone around the ring. The diaphragm may carry, outside the permeated zone, various further zones covered by hard or stiff material, with these latter zones being independent of each other and extending out to the outer edge of the diaphragm. Thus the outer zone of the diaphragm can be provided with a series of three to eight radial bands or strips such that the loudspeaker diaphragm has substantial rigidity or stiffness during the propagation of mechanical vibrations.

Garner et al, U.S. Pat. No. 4,020,299 discloses the general form of a cone for a conical diaphragm loudspeaker. The narrow end of the cone forms a small aperture to which a voice coil is attached. The voice coil is carried in the magnetic field of a permanent magnet and causes oscillation of the diaphragm when a suitable exciting current signal is fed thereto. The conical diaphragm is provided with four substantially radial bands of perforations filled with a damping material said to have having a high level of internal energy absorption to oppose the formation of standing waves in the diaphragm. The composition of the dampening material is unspecified except that it is ambiguously described as a p.v.a. based compound.

In the prior art, paper is commonly used as the diaphragm material which is accomplished by forming the cellulose fibers of paper to a certain configuration using a mold. Alternatively a thermoplastic material may be used. One such material previously suggested for this purpose is a rubber modified styrene which can be vacuum formed into a three dimensional shape. The thickness of such a diaphragm would be in the region of 0.2–0.4 mm.

The diaphragm should have low frequency response characteristics and high flexural wave propagation velocity and retain these characteristics over the life of the cone. Environmental factors such as heat and humidity appear to cause a loss of the desired acoustical characteristics over time.

The present invention relates to the treatment of the speaker diaphragm, preferably composed of paper or plastic and having the typical conical configuration, after it has been formed to extend its original performance life by the application thereto, as a layer or film, or by impregnation, of a polymeric material as more fully described hereinbelow.

SUMMARY OF INVENTION

A diaphragm for a speaker which is adapted to vibrate, the improvement wherein the preformed diaphragm is treated with a solution containing a polymer, which readily dries around room temperature (about 50° F.-about 100° F.) to leave the polymer adhered to the diaphragm whereby the performance of the speaker diaphragm is enhanced and/or restored.

The present invention is particularly adapted for use in connection with loudspeakers of the cone diaphragm type comprising a coil connected mechanically to the apex of a rigid conical diaphragm and moving in the magnetic field produced by a permanent magnet when fed with electrical signals representing the acoustic sounds which transducer is to reproduce.

The preferred polymers are polyolefinic types which are soluble in polar solvents and form an adherent film in the dry state. The following Examples are illustrative.

DESCRIPTION OF PREFERRED EMBODIMENTS

EXAMPLE 1

| | INGREDIENT | %/Wt. |
|---|---|---|
| 1. | Purified Water | 7.403 |
| 2. | Specially Denatured Alcohol-40 (SDA) | 84.370 |
| 3. | Ethyl Ester of PVM/MA Copolymer* | 6.897 |
| 4. | Triethanolamine (TEA) | 0.210 |
| 5. | dL Panthanol | 0.100 |
| 6. | Collogen Amino Acids | 0.800 |
| 7. | Fragrance | 0.220 |
| | TOTAL | 100.000 |

Procedure: Completely blend copolymer in SDA. Add water, panthanol, collogen in order with continuous agitation. Add fragrance, then TEA. Check in 10 minutes, mixing should be complete.

*This copolymer is the partial ethyl ester polymeric resin formed form maleic anhydride and vinyl methyl ether. These copolymers are characterised by the following repeating unit:

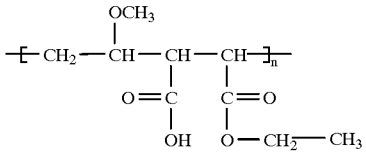

wherein n is an integer from about 10 or 20 up to several thousand, viz, up to about 5,000–10,000 or more. It is to be understood that this chemical structure is idealized and is based on publicly available information describing commercially available materials.

Other suitable vinyl or olefinic-type polymers soluble in polar solvents illustrative of this invention are vinyl acetate-crotonic acid-vinyl neodecanoate polymer, vinyl acetate crotonic acid copolymer, and octylacrylamide-acrylate-butylaminoethyl acrylate polymer.

In general, the present invention is applicable to any polymeric film former that is soluble in a solvent which evaporates at or around room temperature to form an adherent deposit or film on the diaphragm. The preferred solvents are polar solvents such as water, or the lower alkanols (1 to about 6 carbon atoms) such as methanol, ethanol, isopropanol, etc., and mixtures thereof. The polymer is normally present in an amount of 1% to 20% by weight of solution. The solution is preferably applied as an aerosol solution. However, the solution can be applied by wiping, painting or dipping. Various other additives such as fragrances, stabilizers and colorants are optional. The aerosol may be in the form of a hand operated pump spray or in the form of a propellant charged aerosol. Both types of aerosol device will be familiar to those skilled in the art.

EXAMPLE 2

Two identical used speakers which had been used indoors for a substantial number of months and having frusto-conical paper diaphragms were connected to a common stereo sound system having an audio tape deck. Initially, each speaker was played individually and were adjudged by sound to give identical performance. Then, one of the speakers was sprayed as uniformly as possible by aerosol over the entire external (concave) surface with the solution of Example 1 and allowed to dry. The two sound speakers were again sound tested with the same tape as before and it was found that the sound emitted by the speaker to which the solution had been applied was manifestly superior to that the untreated speaker.

Similar results are attainable with new speakers. The application of the spray improves the performance even before the speaker has had time to suffer deterioration in performance.

The following claims and the lawful range of equivalents define the present invention.

I claim:

1. A diaphragm for a speaker which is adapted to vibrate, the improvement wherein the preformed diaphragm is used and aged, and then treated by aerosol spray application with a solution containing a polymer which readily dries at about room temperature to leave the polymer adhered to the diaphragm, whereby the performance of the speaker diaphragm is enhanced and/or restored.

2. The diaphragm of claim 1 wherein the diaphragm is of the conical type.

3. The diaphragm of claim 1 wherein the polymer is a polyolefinic polymer which is soluble in a polar solvent.

4. The diaphragm of claim 1 wherein polymer is present in the solution in an amount of from about 1% to about 20% by weight of solution.

5. The diaphragm of claim 1 wherein the polymer is a copolymer which is a partial ester of maleic anhydride and vinyl methyl ether.

6. The diaphragm of claim 1 wherein the solution includes a polar solvent.

7. The diaphragm of claim 1 wherein the solution includes water and a lower alkanol.

8. The diaphragm of claim 1 wherein the diaphragm is essentially new at the time of treatment.

9. The diaphragm of claim 1 composed of paper.

10. The diaphragm of claim 1 composed of a plastic material.

11. The method which comprises contacting an aged and used speaker cone with an aerosol solution including a polymer which readily dries at about room temperature to leave the polymer adhered to the diaphragm, whereby the performance of the speaker diaphragm is enhanced and/or restored.

12. The method of claim 11 where the polymer is a copolymer which is a partial ethyl ester of maleic anhydride and vinyl methyl ether.

13. The method of claim 11 wherein the polymer is present in the solution in an amount of from about 1% to about 20% by weight of solution.

* * * * *